US008215086B2

(12) United States Patent
Maddaleni et al.

(10) Patent No.: US 8,215,086 B2
(45) Date of Patent: Jul. 10, 2012

(54) METHOD AND DEVICE FOR MANUFACTURING ROLLS OF WEB MATERIAL WITH AN OUTER WRAPPING

(75) Inventors: Romano Maddaleni, Pisa (IT); Mauro Gelli, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 523 days.

(21) Appl. No.: 11/919,667

(22) PCT Filed: Apr. 27, 2006

(86) PCT No.: PCT/IT2006/000289

§ 371 (c)(1),
(2), (4) Date: Nov. 19, 2007

(87) PCT Pub. No.: WO2006/117822

PCT Pub. Date: Nov. 9, 2006

(65) Prior Publication Data

US 2010/0101185 A1 Apr. 29, 2010

(30) Foreign Application Priority Data

May 2, 2005 (IT) ..... FI2005A0087

(51) Int. Cl.
*B65B 63/04* (2006.01)

(52) U.S. Cl. ..... 53/118; 53/399; 53/116; 53/204; 53/211; 242/542.1; 242/542.2

(58) Field of Classification Search ..... 53/399, 53/409, 111 R, 116–118, 428, 430, 203, 204, 53/211, 216; 242/542.1, 542.2
See application file for complete search history.

(56) References Cited

U.S. PATENT DOCUMENTS

| | | | | |
|---|---|---|---|---|
| 1,628,322 | A | 5/1927 | Marcalus | |
| 2,638,725 | A * | 5/1953 | Hurter et al. | 53/139.7 |
| 3,128,057 | A | 4/1964 | Barnhart et al. | |
| 3,505,150 | A * | 4/1970 | Andersson | 156/446 |
| 3,585,779 | A * | 6/1971 | Thayer | 53/118 |
| 3,678,646 | A * | 7/1972 | Clark | 53/397 |
| RE28,353 | E | 3/1975 | Nytsrand et al. | |
| 3,990,215 | A * | 11/1976 | Elsner et al. | 53/553 |
| 4,040,574 | A * | 8/1977 | Johnson | 242/527.3 |
| 4,056,918 | A * | 11/1977 | Matsumoto | 53/118 |
| 4,581,083 | A * | 4/1986 | Schutz et al. | 156/64 |
| 4,723,724 | A | 2/1988 | Bradley | |
| 4,856,725 | A | 8/1989 | Bradley | |
| 4,962,897 | A | 10/1990 | Bradley | |
| 5,104,055 | A | 4/1992 | Buxton | |
| 5,115,734 | A * | 5/1992 | Quartaert | 100/5 |

(Continued)

FOREIGN PATENT DOCUMENTS

| | | |
|---|---|---|
| GB | 672900 | 5/1952 |

(Continued)

*Primary Examiner* — Christopher Harmon
(74) *Attorney, Agent, or Firm* — Breiner & Breiner, LLC

(57) ABSTRACT

A rewinder machine for the production of rolls of web material is described, comprising: a winder unit (3, 5, 7); a path for delivering the web material (N) to said winder unit; a system for continuously feeding said web material into said winder unit; a distributor (31) of a sheet material (F) for wrapping the rolls formed by said winder unit, installed and operated so as to deliver a length of sheet material to said winder unit on completion of the winding of each roll without stopping the forward feed of the web material.

13 Claims, 9 Drawing Sheets

U.S. PATENT DOCUMENTS 5,368,252 A 11/1994 Biagiotti
5,402,960 A 4/1995 Oliver et al.
5,505,402 A 4/1996 Vigneau
5,505,405 A 4/1996 Vigneau
5,513,478 A * 5/1996 Abt ..... 53/118
5,538,199 A 7/1996 Biagiotti
5,542,622 A 8/1996 Biagiotti
5,603,467 A 2/1997 Perini et al.
5,639,046 A 6/1997 Biagiotti
5,657,616 A * 8/1997 Schreiber, Jr. ..... 53/466
5,660,349 A 8/1997 Miller et al.
5,690,296 A 11/1997 Biagiotti
5,769,352 A 6/1998 Biagiotti
5,839,680 A 11/1998 Biagiotti
5,853,140 A 12/1998 Biagiotti
6,050,519 A 4/2000 Biagiotti
6,153,750 A 11/2000 Whitton et al.
6,298,634 B1 10/2001 Cramer
6,370,848 B1 4/2002 Cramer et al.
6,405,969 B1 * 6/2002 Ogren et al. ..... 242/530.4
6,422,501 B1 7/2002 Hertel et al.
6,494,398 B1 * 12/2002 De Matteis et al. ..... 242/521
6,648,266 B1 11/2003 Biagiotti et al.
6,656,033 B2 12/2003 Abe et al.
6,696,458 B2 2/2004 Redkar et al.
2003/0189123 A1 10/2003 Biagiotti et al.

FOREIGN PATENT DOCUMENTS

WO WO 01/64563 A2 9/2001
WO WO 02/055420 A1 7/2002
WO WO 2004/035441 A1 4/2004
WO WO 2004/046006 A2 6/2004

* cited by examiner

23
$f_N$
3
7A
9
L
7
5
$f_{11}$
11A
11
15
17
21
19
13
31
55
37
53
G
F
LT
51A
51
LG

METHOD AND DEVICE FOR MANUFACTURING ROLLS OF WEB MATERIAL WITH AN OUTER WRAPPING

TECHNICAL FIELD

The present invention relates to improvements to the methods and devices for the production of rolls of web material, typically but not exclusively rolls of paper, and especially of tissue paper.

More particularly, the present invention relates to rewinders, particularly of the peripheral or surface winding type, for manufacturing rolls of toilet paper, kitchen towels and other rolls of tissue paper, and to the related manufacturing and winding methods.

STATE OF THE ART

Machines called winders or rewinders are commonly used to manufacture rolls of toilet paper, kitchen towels and other such products in rolls. In these machines, a continuous web material is delivered along a path and fed into a winder unit. Inside the winder unit, rolls of web material are wound in sequence, with or without the aid of winding cores or spindles. The winding systems may be of the central or peripheral type, or even a combination of the two. In the former case, the winding movement is provided by means of central tailstocks or spindles around which the web material is wound, while in the latter case the winding movement is imparted by bringing the roll being formed into contact with one or more continuously moving winding elements, typically belts or winder rollers. In the most common machines, the winding cradle consists of a set of three winder rollers.

In the combined machines, winding is controlled by peripheral and central winding means, or axial supporting elements are provided for the winding cores or spindles. Examples of rewinder machines of this type are described in the U.S. Pat. Nos. 6,513,750; 3,128,057; RE28,353; 5,660,349.

Examples of more modern surface or peripheral winding machines are described in the U.S. Pat. Nos. 5,839,680; 5,639,046; 5,690,296; 5,368,252; 5,538,199; 5,542,622; 5,979,818; 6,648,266; 5,603,467; 5,769,352; 5,853,140; 6,050,519; 6,656,033; 6,696,458; 5,104,055; 5,402,960; 5,505,402; 6,422,501; 4,856,725; 4,962,897; 5,505,405; 4,723,724; in the US patent application 2003/0189123 and in the international patent applications WO-A-2004/035441; WO-A-2004/046006; WO-A-01/64563.

WO-A-02/055420 describes a combined winding device, wherein each roll is formed as a result of the combined effect of motor-driven tailstocks and winder rollers.

The rolls formed by rewinder machines are normally of the same length as the width of the parent reels from which one or more layers of paper material are delivered to the winder unit. The resulting rolls or logs being formed, are subsequently cut into rolls with an axial length suitable for sale and usage.

The finished rolls are usually prepared in packs or other forms of packaging, in multiples of six or twelve rolls, wrapped in plastic film. In some markets, rolls are sold singly, each wrapped in a sheet of wrapping or packaging. For this purpose, particular machines have been designed that are installed downstream from the rewinders and that wrap each log or roll in a protective sheet that is glued in place. Then the roll or log is divided by means of an axial cutting action into shorter rolls, each of which is already packaged in a section of protective wrapping. This packaging system implies the need for an extra machine between the rewinder and the cutting machine, in addition to the packaging machine, which is still needed to produce the multiple packages containing several rolls.

U.S. Pat. No. 1,628,322 describes a rewinder machine wherein the rolls are wound in a winding cradle. At the end of the winding process, the forward feed of the web material used to form the roll is interrupted and a sheet is fed into the winding cradle to form a wrapping around the roll. The wrapped roll is then unloaded from the winding cradle before the forward feed of the web material to create the next roll is restored.

This rewinder machine is unsuited to modern demands for high productivity and is consequently not used.

OBJECTS AND SUMMARY OF THE INVENTION

An object of the present invention is to provide a rewinder or winding machine that enables rolls or logs of wound web material wrapped in a protective sheet or wrapping, to be manufactured in a straightforward manner and at high speed.

The object of a preferred embodiment of the invention is also to provide a method, that is efficient and suitable for the high productivity rates of modern rewinders, for manufacturing rolls or logs of wound web material packaged in an outer sheet of wrapping.

According to a first aspect, the invention concerns a rewinder machine for the production of rolls of web material comprising: a winder unit, a path for delivering the web material to the winder unit; a system for continuously feeding the web material into the winder unit; a distributor of sheets of material for wrapping the rolls formed by the winder unit, arranged and controlled so as to feed lengths or portions of sheet material into the winder unit on completion of the winding of each roll, without interrupting the forward feed of the web material along its delivery path.

With a machine of this type, on completion of the winding of each roll, the roll can be wrapped in a sheet of protective material without stopping the machine and without interrupting the production cycle.

According to a preferred embodiment of the intervention, the winder unit is of the peripheral or surface winding type.

In a possible embodiment of the invention, the distributor of sheet material for wrapping the rolls or logs is arranged along the path for the delivery of the web material to the winder unit. When the winder unit is of the surface winding type, it may include a first winder roller and a second winder roller together forming a nip through which the web material passes. In this case, the distributor of the sheet material for wrapping the outside of the completed rolls may be arranged so as to attach the length of sheet material to the web material upstream from said nip, so that the sheet material for wrapping the finished log or roll moves through the nip together with the final portion of the web material destined to form the last turn of the roll or log.

According to a more advantageous embodiment, however, in addition to the first two winder rollers defining the nip for feeding the web material being wound, the winder unit also includes a third winder roller with a mobile axis that, together with said first two winder rollers, defines a winding cradle wherein the roll is wound in contact with the winder rollers. In this case, according to an advantageous embodiment of the invention, the distributor of sheet material for wrapping the finished roll or log is arranged and controlled so as to deliver lengths of sheet material to the roll by means of one of the winder rollers, and preferably by means of the third, mobile-axis winder roller.

For this purpose, the third winder roller may include a gripping device, i.e. means for engaging the length of sheet material in order to transfer said sheet material to the wound roll and to wrap it around said roll. For instance, according to a particularly advantageous embodiment of the invention, the third winder roller may have a perforated cylindrical surface and contain a suction box, so that a portion of the winder roller exerts a suction force and can thereby engage the sheet material so as to transfer it to the roll.

According to another aspect, the invention relates to a method for packaging rolls of web material, comprising the following steps:

- continuously delivering the web material along a path and feeding it to a winder unit;
- winding up a predetermined amount of web material to form a first roll;
- severing the web material to form a loose tail end of the first roll and a leading end of a second roll without stopping feed of the web material;
- wrapping the first roll with a length of sheet material;
- unloading the first roll, wrapped in said sheet material, from the winder unit;
- beginning to wind up a second roll.

According to an embodiment of the method according to the invention, the length of sheet material is attached to the web material by means of an adhesive, though other application methods are feasible.

In an embodiment of the method according to the invention, an adhesive is applied to the sheet material in the vicinity of a leading end and of a tail end, and the length of sheet is attached to the web material of the roll by means of said adhesive applied in the vicinity of the sheet leading end, while its tail end is glued to the outer surface of said length of sheet material, by means of the adhesive applied in the vicinity of said tail end.

According to an embodiment of the invention, the method comprises the following steps:

- adhering the leading end of the portion or length of sheet material to the web material as the latter moves along its forward feed path;
- advancing the length of sheet material towards the winder unit together with the web material;
- severing the web material downstream from the leading end of the length of sheet material.

The following stages are involved in a fine-adjusted variant of this embodiment of the method according to the present invention:

- providing a first winder roller and a second winder roller forming part of said winder unit, arranged so as to define a nip between said first and second winder rollers;
- feeding the web material into said nip;
- forming at least a part of the roll in contact with the first and the second winder rollers;
- attaching the length of sheet material to the web material upstream from the nip;
- passing the length of sheet material through the nip and winding the length of sheet material around the completed roll after interrupting the web material.

In a further embodiment, the method according to the invention involves the following stages:

- providing a first winder roller and a second winder roller forming part of said winder unit, arranged so as to define a nip between said first and second winder rollers;
- providing a third, mobile-axis winder roller so as to define a winding cradle together with said first and said second winder rollers;
- feeding the web material into said nip;
- winding at least a part of the roll in contact with the first, second and third winder rollers, the third winder roller having an axis movable according to the increase in the diameter of the roll;
- on completion of the winding of the roll, collecting the length of sheet material by means of one of the winding rollers, and preferably by means of the third winding roller, and wrapping it around said roll.

The invention also relates to a rewinder machine for manufacturing rolls of web material, comprising: a winder unit, a path for delivering web material to the winder unit; a distributor of sheets of material for wrapping the rolls, arranged and controlled so as to feed a length of sheet material along said web material delivery path on the completion of the winding of each roll.

According to an advantageous embodiment, along the path for delivering the web material, a device for attaching said length of sheet material to said web material is arranged.

According to a preferred embodiment of the invention, the machine comprises an adhesive distributor for applying an adhesive to said length of sheet material to attach said length of sheet material to said web material.

Advantageously and preferably, the winder unit comprises at least a first winder roller and a second winder roller, which together define a nip through which the web material passes, and through which said length of sheet material is fed.

According to another aspect, the invention also concerns a rewinder machine for manufacturing rolls of web material, comprising: a winder unit with at least a winder roller; a path for the delivery of the web material to said winder unit; a distributor of sheets of material for wrapping the rolls formed by said winder unit, arranged and controlled so as to feed a length of sheet material to said winder roller on completion of the winding of each roll. Preferably, a distributor of adhesive may also be provided for applying an adhesive to said length of sheet material to attach the length of sheet material to said web material. The roller to which the length of sheet material is fed can preferably be a mobile roller for controlling the increase in the diameter of the roll being wound, and said roller can, for instance, be part of a three-roller winder unit, of continuous type, i.e. wherein there is no need to stop or substantially slow down the delivery of the web material on completion of the formation of each roll.

According to yet another aspect, the present invention relates to a method for packaging rolls of web material wherein a web material is delivered along a path and fed into a winding unit; and wherein, on completion of the winding of the roll, a length of sheet material for wrapping said roll is inserted along the path for delivery of the web material and thus fed into said winding unit.

To feed the length of sheet material into the winding unit, provision is preferably made for said sheet to be attached to the web material along said path, so that the sheet is entrained into the winder unit by the web material.

BRIEF DESCRIPTION OF THE DRAWINGS

The invention is better illustrated with the aid of the description of the attached drawing, which shows practical embodiments without restricting the scope of the invention. To be more precise, in the drawing.

DETAILED DESCRIPTION OF EMBODIMENTS OF THE INVENTION

Figure 1:
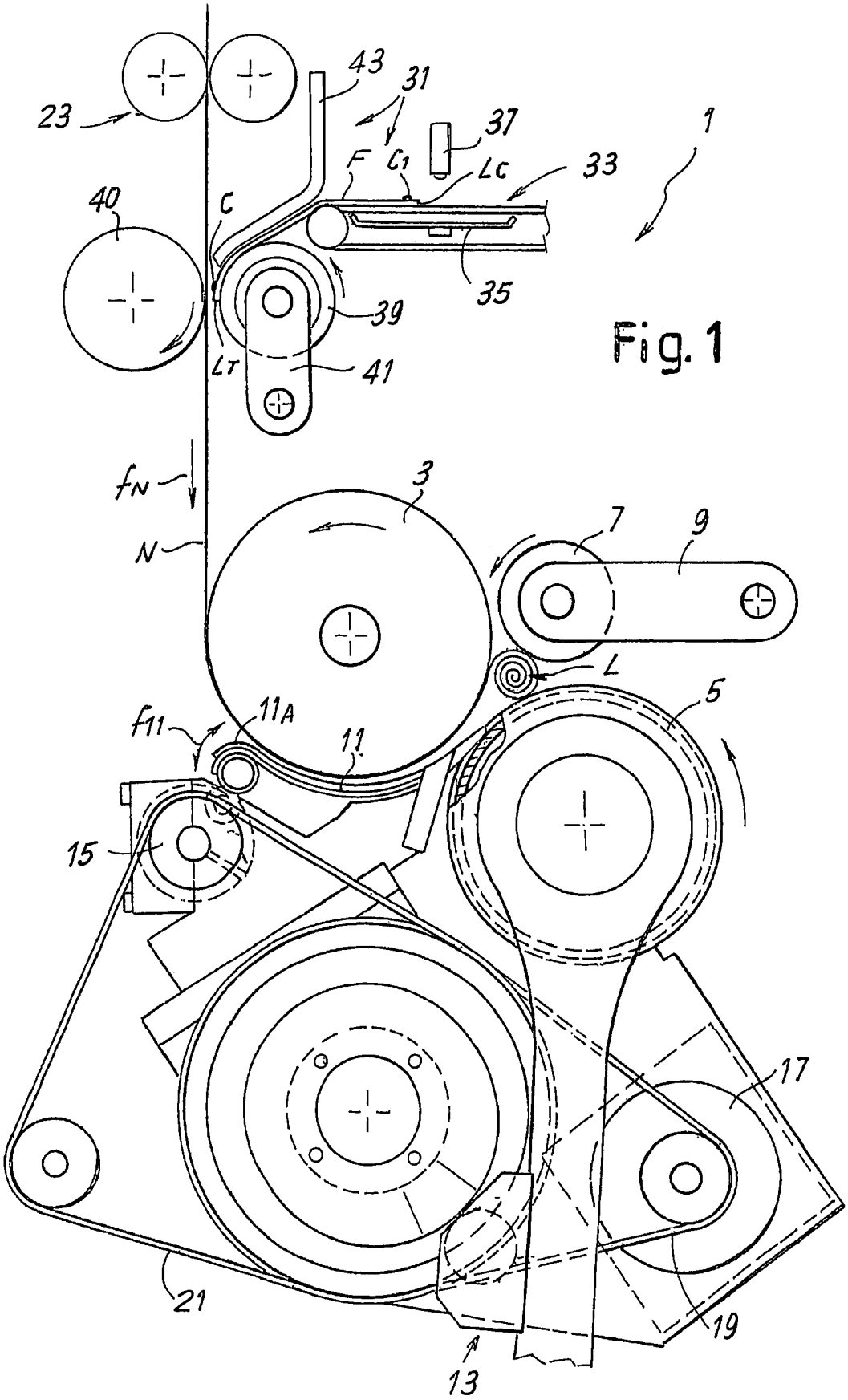
FIGS. 1 and 2 show a first embodiment of the invention in two successive moments of a winding cycle.
Figure 2:
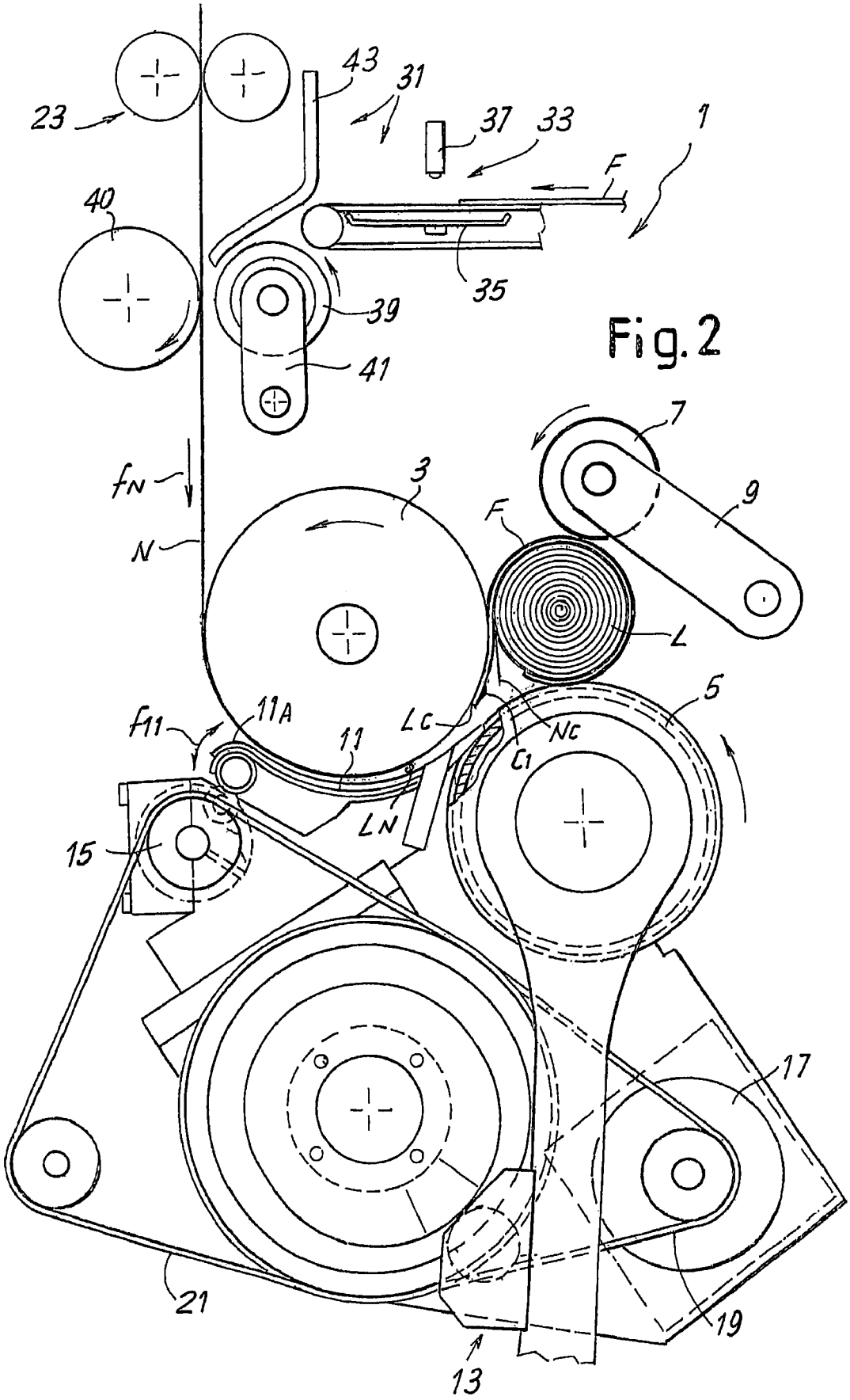

FIGS. 1 and 2 schematically show a rewinder according to the invention in a first embodiment, in two distinct moments in a winding cycle. In this case, the rewinder is configured to produce coreless rolls or logs.

The rewinder is configured (as far as the winding elements are concerned) essentially as described in U.S. Pat. No. 5,639,046, to which the reference for a more detailed description of the structural features and operation of this type of rewinder.

FIGS. 1 and 2 show the essential parts of the winding head. The rewinder, globally indicated by the numeral 1, comprises a first winder roller 3, a second winder roller 5 and a third winder roller 7. The three winder rollers together form a winding cradle wherein a roll or log L is formed. The log L formed by the rewinder is subsequently cut, crosswise to its axis, into single rolls or shorter rolls of axial length corresponding to the length of the end product.

The winder roller 7 is carried by oscillating arms 9 and is gradually raised so as to enable and control the increase in size of the log L. The three rollers 3, 5, 7 turn in the same direction (anticlockwise in the example) at much the same peripheral speed during the winding of the roll or log L, while the speed of the lower winder roller 5, and possibly also of the roller 7 for controlling the log diameter, varies (the former decelerating, the latter accelerating) in the exchange stage, i.e. when the completed roll or log L is unloaded, and a new log L is loaded in the initial winding stage, according to methods already known to a person skilled in the art.

A nip is created between the rollers 3 and 5, through which the web material N to be wound in order to form the roll or log L is passed (moving in the direction of the arrow fN). Upstream from the nip created between the rollers 3 and 5, there is a concave surface 11 consisting of a curved sheet of a metal, carbon fiber reinforced resin or other suitable material. This concave surface is capable of an oscillating movement in the direction of the arrow f11 so as to pinch the web material N against the outer surface of the winder roller 3, thereby causing a tear in the web material and consequently causing the fashioning of the central portion of a new log to start by means of the curling of the leading end of the severed web material, as described in more detail in the previously-mentioned U.S. Pat. No. 5,639,046.

The numeral 13 indicates a unit supporting the surface 11 and capable of moving closer to, or further away from the roller 3 so as to bring the surface 11 closer to, or further away from said roller. The unit 13 also supports a control mechanism 15 driven by a motor 17 by means of belts 19 and 21, for inducing a rapid pinching of the web material N by the portion 11A of the curved surface 11 against the cylindrical surface of the roller 3, as already described in the previously-mentioned U.S. Pat. No. 5,639,046.

Along the path of the web material N being fed into the winding head, there is a perforator, schematically indicated by the numeral 23, that generates crosswise perforation lines in the web material N so as to divide the material into single portions which can be detached by tearing along the perforation line when the finished roll is in use.

Characteristically, upstream from the inlet to the channel defined between the outer surface of the winder roller 3 and the concave surface 11, there is a sheet material distributor, which is used to deliver single sheets or lengths of sheet material (with which each roll or log L is wrapped after it has been completed) along the path feeding the web material N to the winder unit consisting of the rollers 3, 5, 7. The distributor is globally indicated by the numeral 31.

This sheet applicator or distributor 31 comprises a conveyor 33 with an associated suction box 35 situated underneath the upper branch of the conveyor 33. One, or a row of several nozzle(s), schematically indicated by the numeral 37, are installed along the conveyor 33 and, in certain pre-established positions they apply an adhesive to the upper surface of the sheet F in transit on the conveyor 33 in order to make said sheet adhere to the web material N in a manner described later on.

Downstream from the conveyor 33, there is a roller 39 that is kept constantly turning in a direction congruent with the direction in which the web material N is fed forward along its path which passes between the roller 39 and the winder roller 3. The roller 39 is mounted on oscillating arms 41 controlled by means of an actuator (not shown) so as to push the roller 39 up against the roller 40 at a predetermined time in order to attach the sheet F to the web material N.

The sheet F is fed forward by the conveyor 33 until it occupies the position schematically illustrated in FIG. 1, wherein the leading end of the sheet F is held against the outer surface of the rotating roller 39, which may be perforated over its entire surface, for instance, and kept at a slightly negative pressure on the inside by means of a fan. A deflector 43 guides the sheet F so that it comes to rest correctly on, and remains attached to the turning cylindrical surface of the roller 39. The suction force exerted by the suction box 35 is stronger than the suction force exerted by the rotating roller 39, and consequently holds the sheet F up until it is inserted, in a manner described later on, along the path of the web material N. As an alternative to the suction box 35, there may be other types of retention means, e.g. mechanical devices. The one or more nozzles 37 apply two lines of adhesive C and C1 to the upper surface of the sheet F in the vicinity of the leading and tail ends, respectively, of the sheet F. These lines of adhesive preferably run approximately parallel to the crosswise edges of the sheet F, i.e. perpendicular to the direction in which the sheet is being fed forward, and may be continuous or discontinuous, e.g. consisting of sets of spots of adhesive in a row. An adhesive can also be applied to the sheet F at a previous stage in the production process, e.g. using an adhesive that is activated only when it is used.

The operation of the rewinder configured in this way is as follows (see the sequence in FIGS. 1 and 2). In FIG. 1, the web material N advances along its delivery path in the direction of the arrow fN and is wound up to form a roll or log L in the winding cradle consisting of the rollers 3, 5 and 7. There is a sheet F in the distributor 31, with its leading end LT in contact with the roller 39, which turns at a peripheral speed approximately corresponding to the forward feed speed of the web material, but without touching the latter. An adhesive C has been applied by nozzle 37 in the vicinity of said leading end LT, while a second line of adhesive C1 has been applied in the vicinity of the tail end LC. The latter comes to be above the suction box 35, so that the sheet F is held in the position illustrated in FIG. 1 up until it is inserted in the rewinder.

When the log L has been formed, the roller 39 is brought up against the roller 40 so that the leading portion of the sheet F is pinched between the rollers 40 and 39 and accelerates, advancing together with the web material N. The line of adhesive C ensures that the sheet F adheres to the web material N and continues to advance together with the latter even after it has lost contact with the roller 39. The web material N, to which the sheet F has been attached on the surface facing towards the winder roller 3 (and forming the outer surface of the log L) advances up to the winder unit 3, 5, 7 and is torn or otherwise severed along the perforation line generated by the perforator 23 in a way known per se, due to the oscillation of the oscillating curved surface 11, the portion 11A of which comes into contact with the web material, pinching it against the roller 3. The insertion of the sheet F is synchronized with the position of the perforation line, along which the web material must be torn so that the tail end LC of the sheet F comes to be in a position in which it extends slightly beyond the tail end of the torn web material.

After it has been torn, the leading end of the web material N formed by said severing of the web material begins to curl inside the nip between the surface 11 and the roller 3, thereby creating the first nucleus LN of a new log (FIG. 2), while the tail end NC of the web material is wound onto the log L that, though still in the winding cradle 3, 5, 7, begins to be unloaded by means of a change in the peripheral speed of the roller 7 and/or of the roller 5.

As illustrated in FIG. 2, the sheet F has formed a turn that wraps around the roll or log L. The leading end LT adheres to the outer surface of the last turn of the web material wound onto the log L, while the tail end LC, already adhering to the web material N by means of the line of adhesive C1, once it has been wound around the log L, also adheres to the outer surface of the sheet F in the vicinity of the leading end LT due to the same line of adhesive C1 seeping through the material.

The roll thus wrapped is unloaded forward to the next station in the production line.

Figure 8:
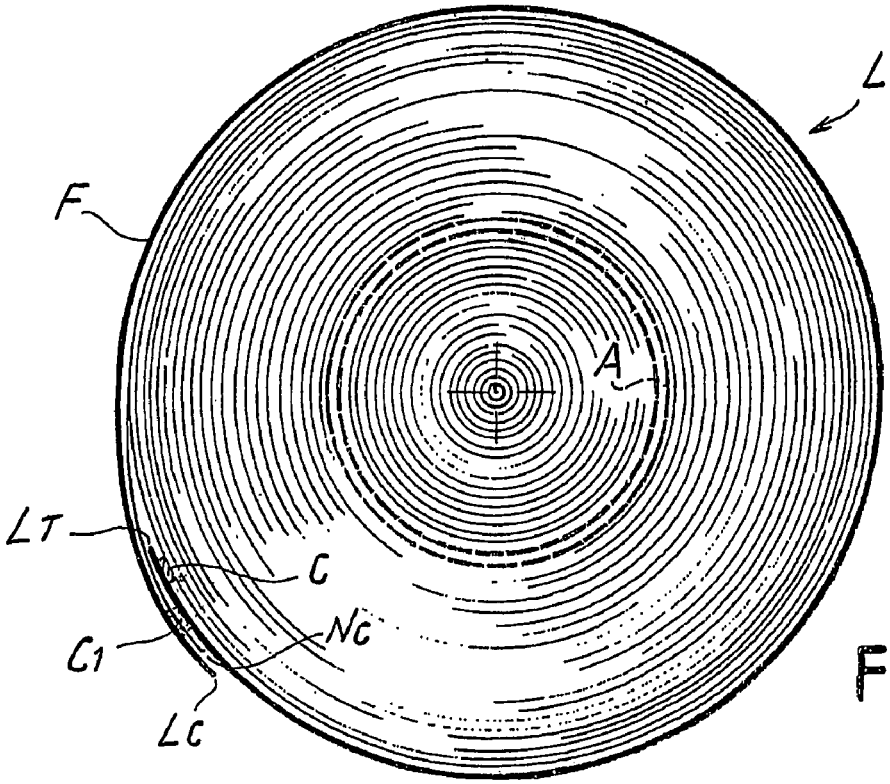

FIG. 8 shows a schematic enlargement of the roll or log L thus obtained. FIG. 8 also indicates a tubular winding core by means of a dotted line, because the same product could also be obtained with a rewinder that uses tubular winding cores, as explained later on.

The wrapping sheet F is thus wrapped around the final turn of the web material that ends with the tail end NC. The leading end LT of the sheet lies underneath the last portion of web material N ending with the tail end NC, and is glued to the underlying turn of web material by means of the adhesive C.

The tail end LC of the sheet F preferably extends beyond the tail end NC of the web material, while the line of adhesive C1 makes the sheet F adhere to the last portion of the web material N and, by seeping through the latter, ensures the adhesion of the web material N to the back of the sheet F in the vicinity of the leading end LT. Alternatively, if the characteristics of the adhesive applied to the sheet F are unsuitable for it to seep through the material and thereby ensure the adhesion of the loose tail end NC of the web material N on the back of the wrapping created by the sheet F, then provision can be made for the application of a line of adhesive to the web material N by means of a specific distributor of known type with an adhesive distributor nozzle, for instance, in a position synchronized with the position of the perforation line where the web material is to be torn and the tail end NC of the web material N is created.

Figure 3:
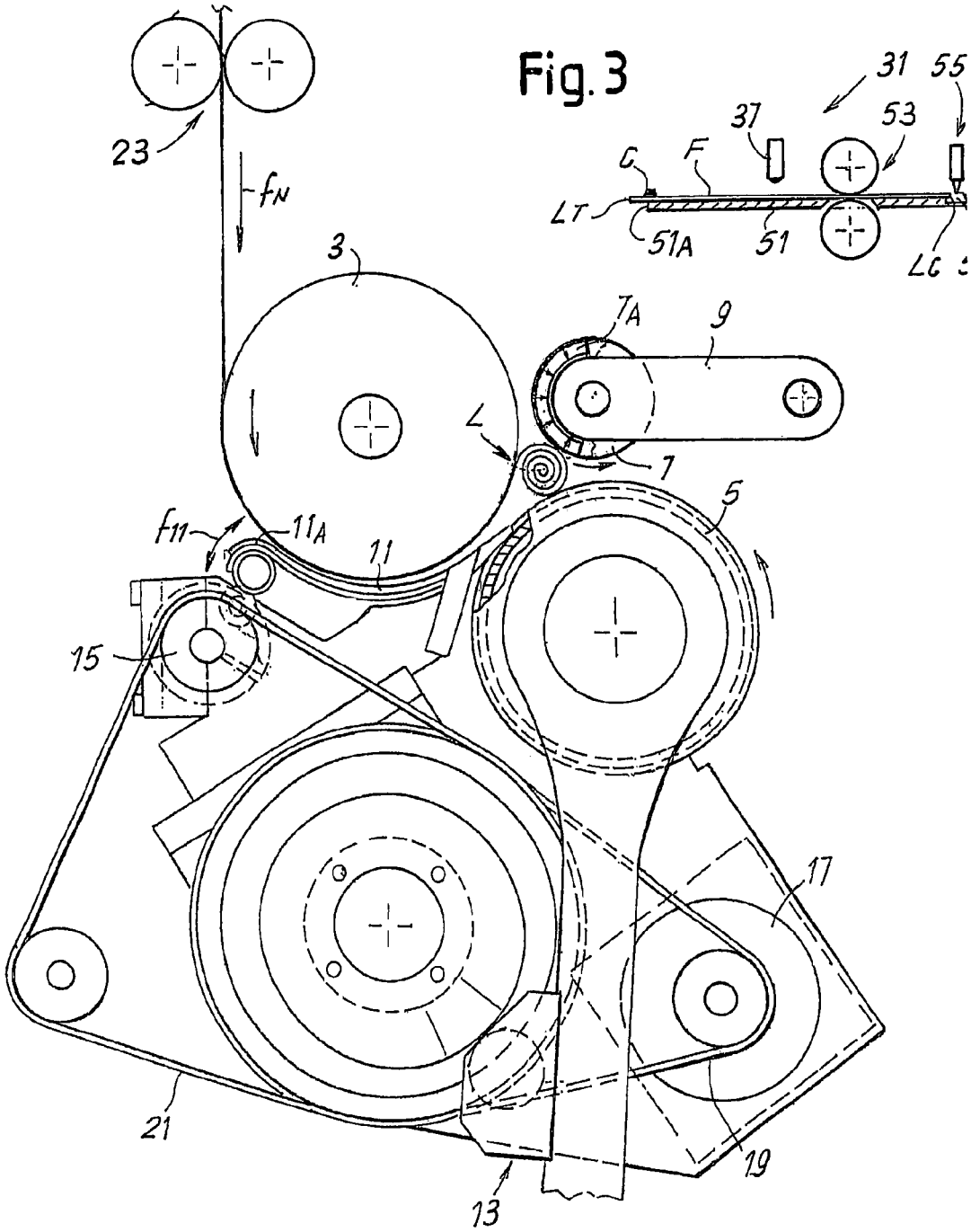
FIGS. 3 and 4 show a second embodiment of the invention in two separate stages of a winding cycle.
Figure 4:
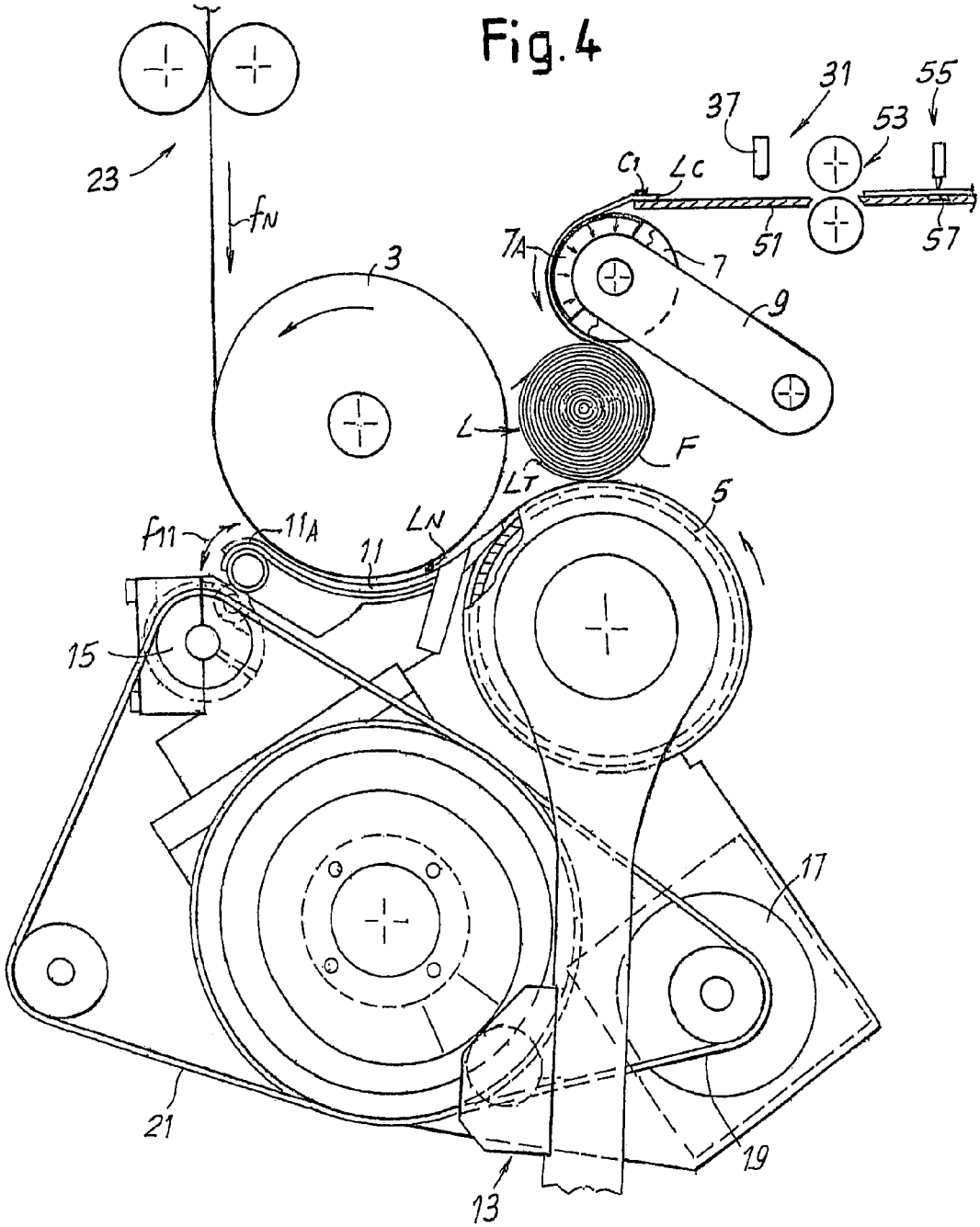

FIGS. 3 and 4 show a different embodiment of a rewinder machine for the production of coreless rolls or logs in two distinct stages of the winding cycle. The same numbers are used to indicate the same (or equivalent) parts as those illustrated in FIGS. 1 and 2.

In this embodiment, the distributor 31, which delivers the lengths or portions of sheet material F for wrapping around the outside of the roll or log L after it has been wound, is associated with the third winder roller, i.e. with the winder roller with a mobile axis, indicated by the numeral 7 and carried by the oscillating arms 9. In this embodiment, the distributor 31 has a supporting surface 51 along which the sheet F is fed, for instance by means of a pair of motor-driven rollers 53 or other suitable means. The surface 51 has associated nozzles for applying adhesive 37 corresponding to those illustrated in FIGS. 1 and 2, which apply an adhesive C in the vicinity of the leading end and/or of the tail end of each sheet F. This example also shows a blade 55 cooperating with a hollow or cavity 57 associated with the surface 51 for dividing the sheet F into single lengths if it is delivered from a roll or reel, though it may be that the sheets are delivered from a stack of single, precut sheets, or they may be separated by tearing along perforation lines by known means.

The tail end 51A of the supporting surface 51 lies in a position (which may be adjustable in relation to the diameter of the rolls or logs L to produce) so that, when the mobile winder roller 7 is in its uppermost position, the leading end LT of the sheet material F touches the cylindrical surface of the roller 7, as illustrated in FIG. 4. The roller 7 includes members suitable for retaining and entraining the sheet material so as to complete the wrapping of the roll or log. In a possible embodiment, as illustrated in the figure, these members comprise a suction sector 7A and perforations all over the cylindrical surface in order to make the sheet F adhere to the roller. It is also feasible to use other retention means or members, e.g. mechanical means, comprising a system of clips, hooks or the like, on the surface of the winder roller 7.

The operation of the machine illustrated in FIGS. 3 and 4 is as follows. In FIG. 3 the winding of the roll or log L has begun in the cradle created by the rollers 3, 5 and 7, the web material N having been severed and the curling of the log having begun along the curved surface 11 in the manner previously described and illustrated in greater detail in the U.S. Pat. No. 5,639,046.

When the roll or log L has been completed and the web material N has been severed (FIG. 4), the winding of the nucleus LN of a new roll begins in the channel between the curved surface 11 and the roller 3, while the completed roll or log L is wrapped in the sheet material F.

For this purpose, the material is engaged by the suction portion 7A of the mobile-axis winder roller 7. The suction force makes the free leading end LT of the sheet material F remain attached and advance towards the cylindrical surface of the log L. Any line of adhesive C applied in the vicinity of the leading end LT makes the sheet adhere to the outer surface of the last turn of web material N wound onto the roll or log L. The log continues to turn and the sheet F continues to be wound around the outside of the log L to provide a complete wrapping. The nozzles 37 apply an adhesive in the vicinity of the tail end LC of the sheet material F in order to seal or fix the sheet around the completed log, which is then unloaded from the winding cradle in a known manner, by means of a difference in the peripheral speeds of the winder roller 7 and the winder roller 5.

Figure 6:
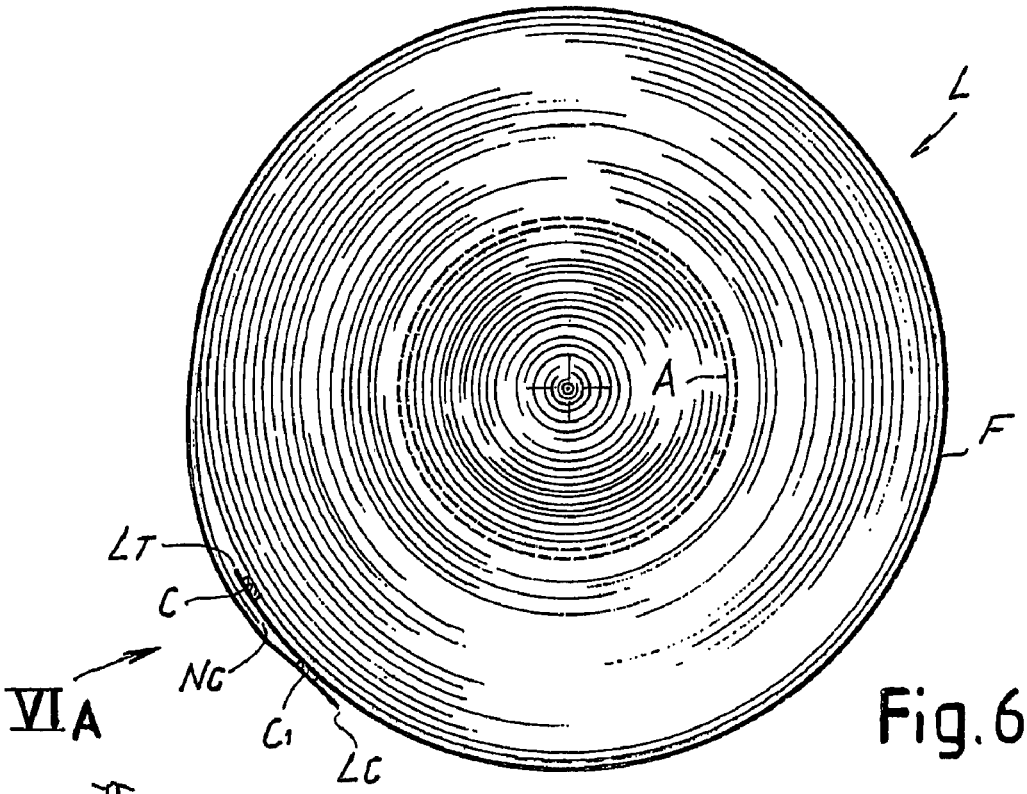
FIG. 6 shows a schematic front view of a roll prepared with a machine according to the invention.
Figure 6A:
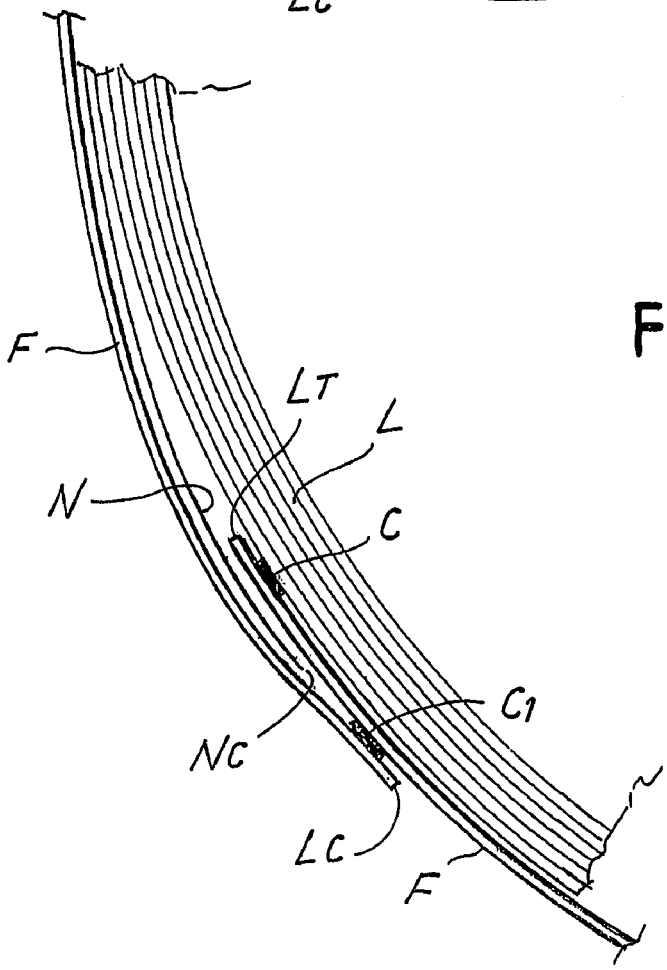
FIG. 6A shows an enlargement of the area indicated by the letter A in FIG. 6.

The type of wrapping obtained using this operating method is illustrated in detail in FIGS. 6 and 6A. The line of adhesive C in the vicinity of the leading end LT could be omitted because in this case the sheet F does not have to advance together with the web material N along its forward feed path to the winding cradle because it is always controlled by the winder roller 7, which is in contact with the log L being wound. Moreover, unlike the situation using the operating mode of FIGS. 1 and 2, if the line of adhesive C is omitted, the sheet F is only glued to itself and is free to slide around the web material N; thus, when the wrapped roll of product is used, the sheet F can simply be removed by sliding it off the roll because there is no intermediate anchorage and the roll is immediately ready for use, without having to detach the initial end or the first turn of web material N from the wrapped roll.

In the embodiments illustrated so far, the rewinder machine is configured to produce coreless rolls L. The same principle can also be applied, however, to rewinder machines that form the rolls or logs L around tubular winding cores (made of cardboard, for instance) in the conventional way. Figures from 5A to 5D illustrate the operating sequence of a rewinder machine of this type.

The basic configuration of the rewinder machine and its operation, as far as the winding of the web material, the severing of the web material, the insertion of the winding cores, the beginning of the winding process, and the unloading of the completed logs are concerned, are described in detail in U.S. Pat. Nos. 5,979,818 and 6,148,266, to which reference can be made for further details. Only the basic features of the rewinder are mentioned herein.

It comprises three winder rollers 3, 5 and 7 defining a winding cradle similar to the one described so far with reference to the previous figures. Around the main winder roller 3, which guides the web material N around it, feeding it forward, there is a curved surface 101 along which the winding cores A roll and are inserted sequentially in the machine for each winding cycle. The curved surface 101 is approximately concentric to the roller 3 and defines a channel 103 wherein the winding cores A are inserted by means of a pusher 105, the cores being delivered to the rewinder by means of a chain conveyor 107 or other suitable means.

Underneath this rolling surface 101 there is an axis of rotation 110 around which a severing element or member 113 turns and, as explained in the above-mentioned U.S. Pat. Nos. 5,979,818 and 6,648,266, separates the web material on completion of the winding of a roll or log L to enable the winding of a new roll to begin on a new winding core A inserted in the channel 103. The web material is severed in a suitable position between the log L and the new winding core A, when they are in the positions illustrated in FIG. 5A or 5B.

The winder roller 7 having a mobile axis is associated with a distributor 31 of sheets or lengths of a sheet material F for wrapping the single logs once they have been wound. In the example shown, the distributor 31 comprises a sliding surface 51 the edge or terminal part 51A of which lies adjacent to the cylindrical surface of the roller 7 when the latter occupies its uppermost position (FIG. 5A), to enable the leading end of the sheet F to be taken up and fed forward to the winding cradle defined by the rollers 3, 5 and 7, in much the same way as described in relation to FIGS. 3 and 4.

In the example illustrated, the surface 51 is associated with a pair of rollers 53 that feed the sheet material F forward, unwinding it from a reel B downstream from which there are severing means 55 for dividing the sheet material F into single lengths.

The numeral 37 is again used to illustrate a distributor of adhesive, for instance in the form of a set of nozzles aligned crosswise to the direction in which the sheet F advances. The nozzles 37 apply crosswise lines of adhesive to the sheet F in the vicinity of the tail end LC and possibly also in the vicinity of the leading end LT of the sheet F, for the purposes previously explained.

Here again in this embodiment, the winder roller 7 takes up the sheet F by means of a suction segment 7A around the winder roller 7.

It is also feasible, however, to use different and alternative systems for engaging the sheet F (this also applies to the example of an embodiment described with reference to FIGS. 3 and 4), such as electrostatic systems or mechanical systems. The latter could consist of studs, pins, or other retention means that are promptly made to project from the cylindrical surface of the roller 7 at the appropriate moment and penetrate the leading portion of the sheet F. For this purpose, there may also be a contrasting member, such as a counter-roller opposite the front edge 51A of the supporting surface 51 to counter the action of the pins projecting from the roller 7 and enable their penetration in the sheet F.

Figure 5A:
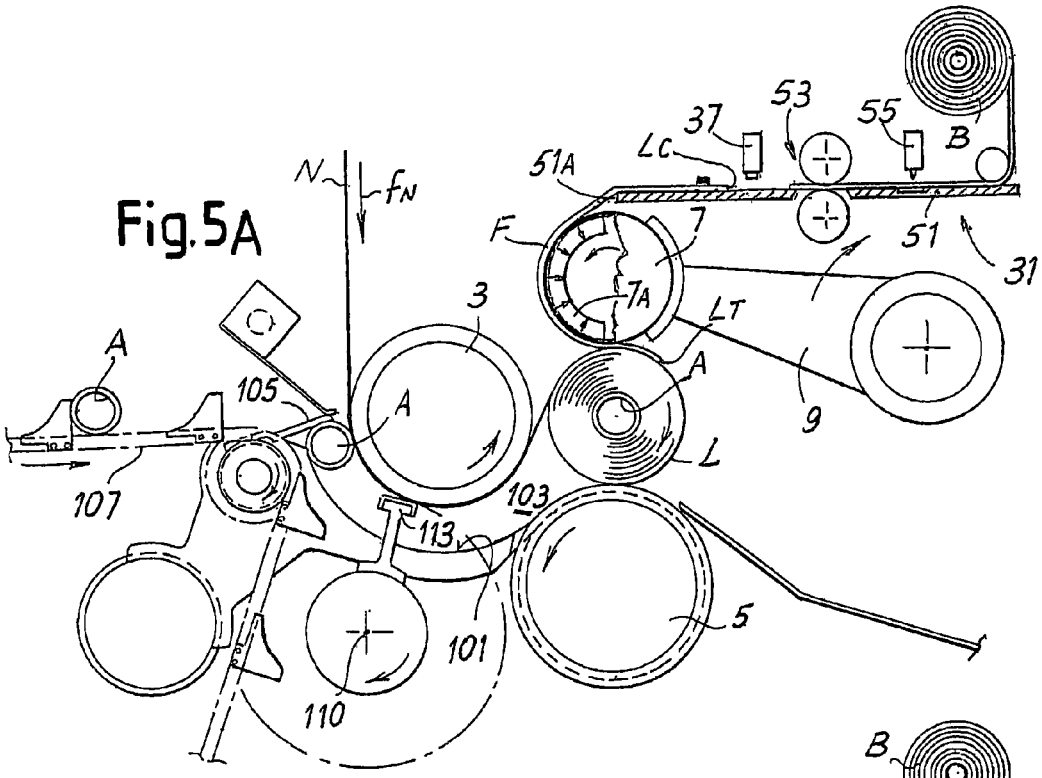
FIGS. 5A to 5D show various stages of the winding cycle in a third embodiment of the invention.

The operation of the machine is clearly shown in the sequence of FIGS. 5A to 5D. In FIG. 5A the roll or log L is virtually complete and the mobile winder roller 7 is in the uppermost position adjacent to the edge 51A of the surface 51 of the distributor 31. Due to the suction force in the suction segment 7A, the sheet F (already provided with a line of adhesive) has been engaged by the roller 7 and advances towards the winding cradle.

In the arrangement illustrated, the leading end LT is already in contact with the log L. The means for severing the web material, indicated by the numeral 113, are in the working position inside the channel 103 and, in the example illustrated, said means turn at a lower peripheral speed than the forward feed speed of the web material N or the peripheral speed of the winder roller 3. A new winding core A is pushed into the opening in the channel 103 by the pusher 105.

Figure 5B:
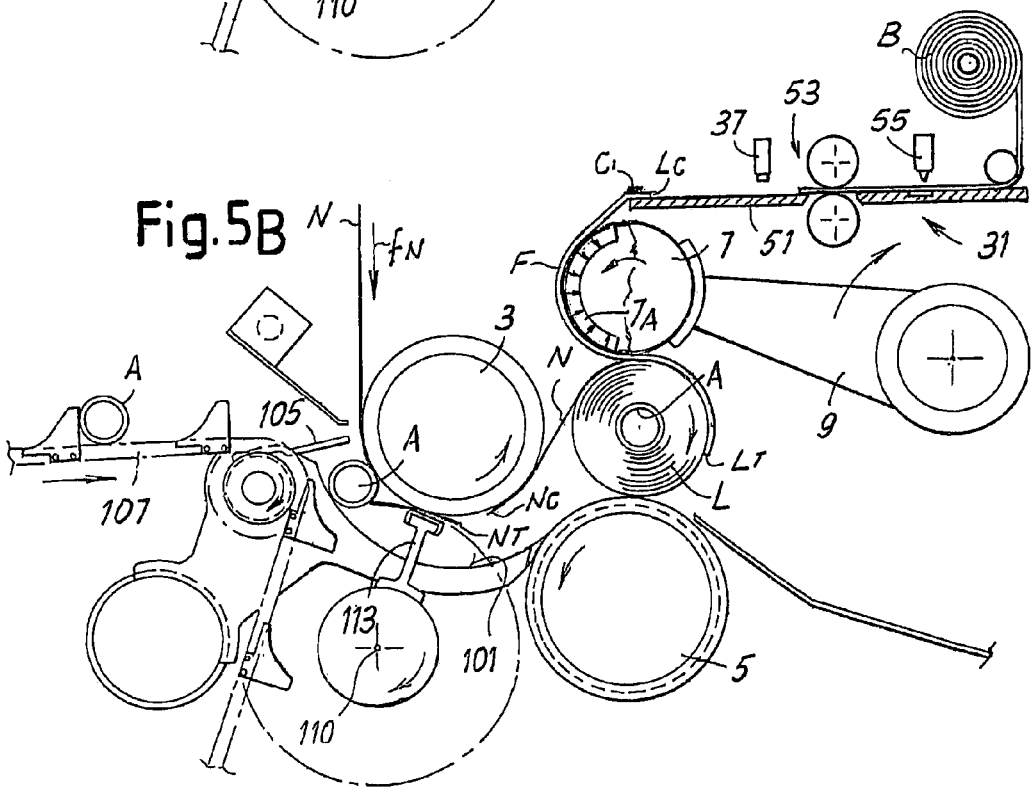

In FIG. 5B the web material N has been torn or severed along a perforation line, thereby forming a leading end NT and a tail end NC. An adhesive has already been applied to the core A inserted in the channel 103 so that the front portion of the web material N adheres thereto and thus begin the new winding. Instead of an adhesive, other known means of adhesion may also be used, such as a suction force from inside the tubular core A, which in this case would be suitably perforated. The sheet material F continues to wind around the completed roll or log L, thereby wrapping the latter.

Figure 5C:
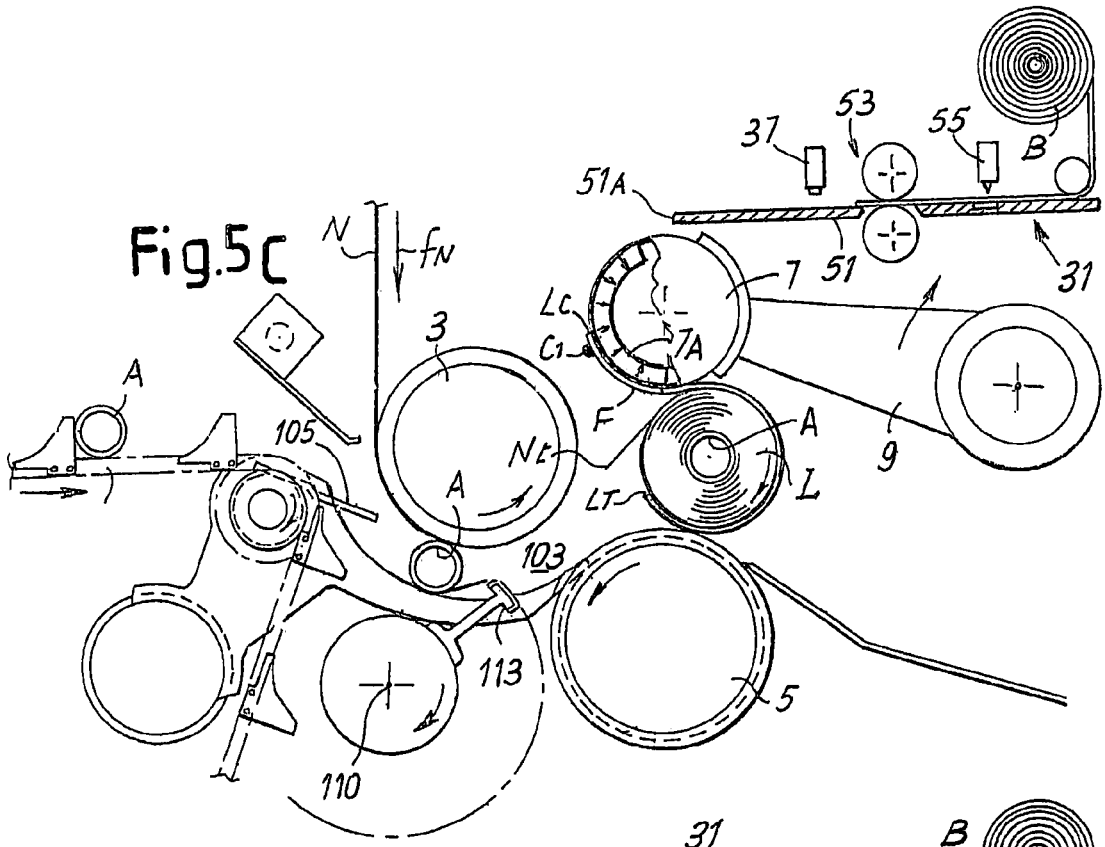

In FIG. 5C the sheet F has practically completed the formation of a turn of wrapping around the log L, which advances towards a chute to be unloaded from the rewinder due to the effect of a difference in speed between the roller 7 and the roller 5. The tail end FC, provided with the line of adhesive C1, adheres to the outer surface of the log L and, to be more precise, to the exposed surface of the sheet F in the vicinity of the leading end which, in this example, will come to be in a position underneath the tail end NC of the web material N.

Figure 5D:
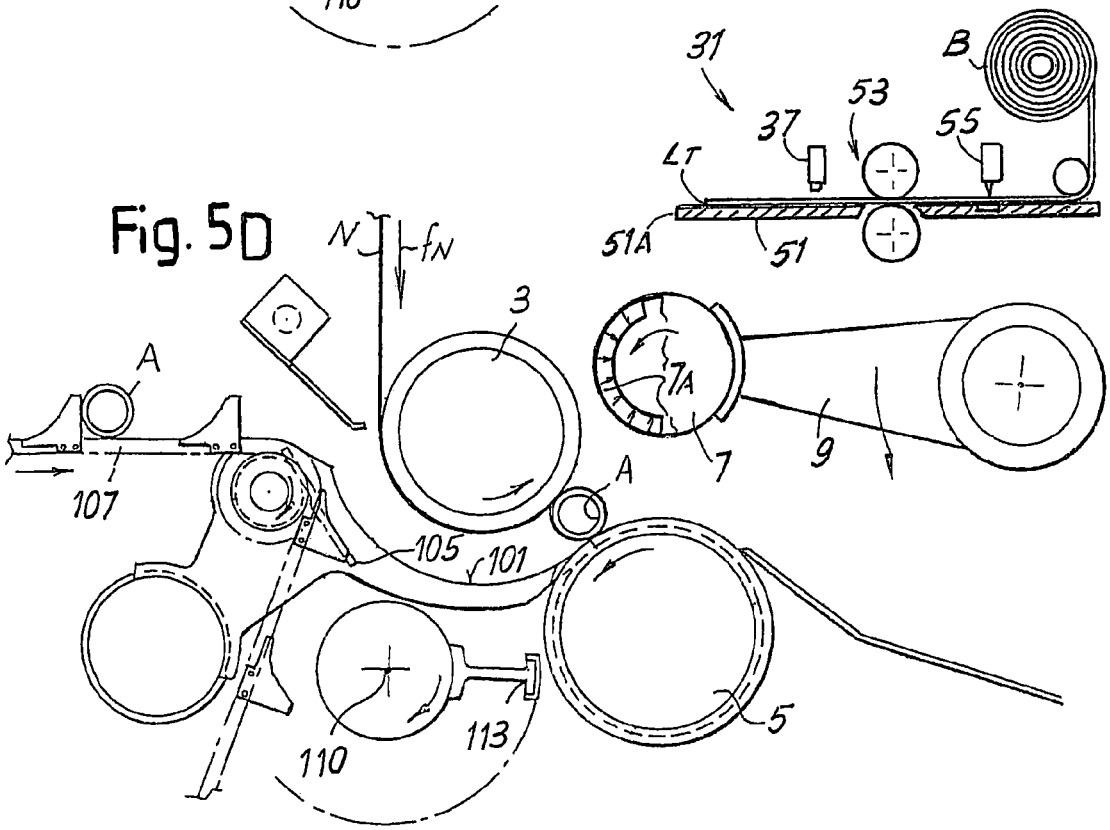

FIG. 5D shows the moment when a new core A, with the first turns of web material wound thereon, passes through the nip between the rollers 3 and 5 to enter the winding cradle formed by the set of three rollers 3, 5 and 7. The roller 7 comes down to return to its working position in contact with the new roll being formed.

Figure 7:
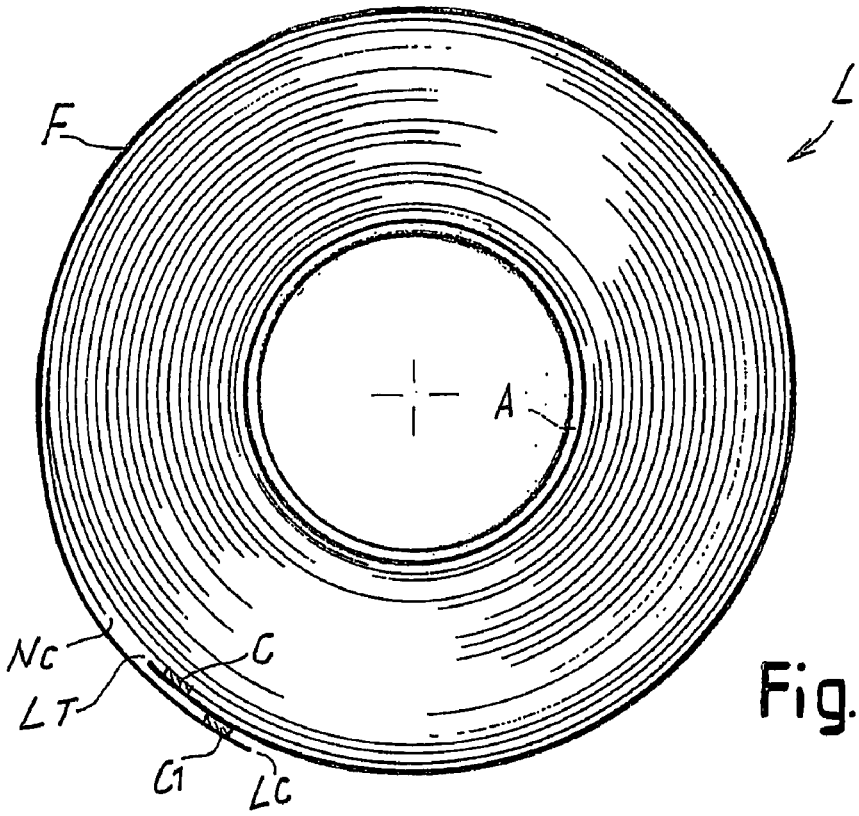
FIGS. 7 and 8 are front views of a roll or log prepared with a machine according to the invention in various embodiments.

The product obtained by this operating method may be similar to the one illustrated in FIGS. 6 and 6A, or it may take the form illustrated in FIG. 7. In this case, the tail end NC of the web material is shorter and does not come between the leading and tail ends LT and LC of the sheet material F. In fact, when the sheet material F is applied by the winder roller 7 (FIGS. 3, 4, 5), there is no longer any need to phase the leading end LT of the sheet material F with the tail end of the web material NC because the latter has already been torn by the time the former is applied. Or rather, when the application of the leading end LT to the web material N begins, the latter may or may not have already been torn, or otherwise severed. The web material N will in any case have been torn by the time the application of the sheet material F to the web material N has been completed.

In much the same way as illustrated and described with reference to FIGS. 2, 3, 4 and 5, the length of sheet material F can be delivered and applied by the lower roller 5. In this case, there may be a unit 31 (in much the same way as described and illustrated above for the mobile roller 7) installed alongside the roller 5 underneath the chute for unloading the rolls or logs. On completion of the winding of each roll, the roller 5 takes up a length of sheet material F, by suction for instance, and, turning anticlockwise, brings it into contact with the wound roll, making it adhere thereto according to the method described above for the mobile-axis roller 7.

Figure 9:
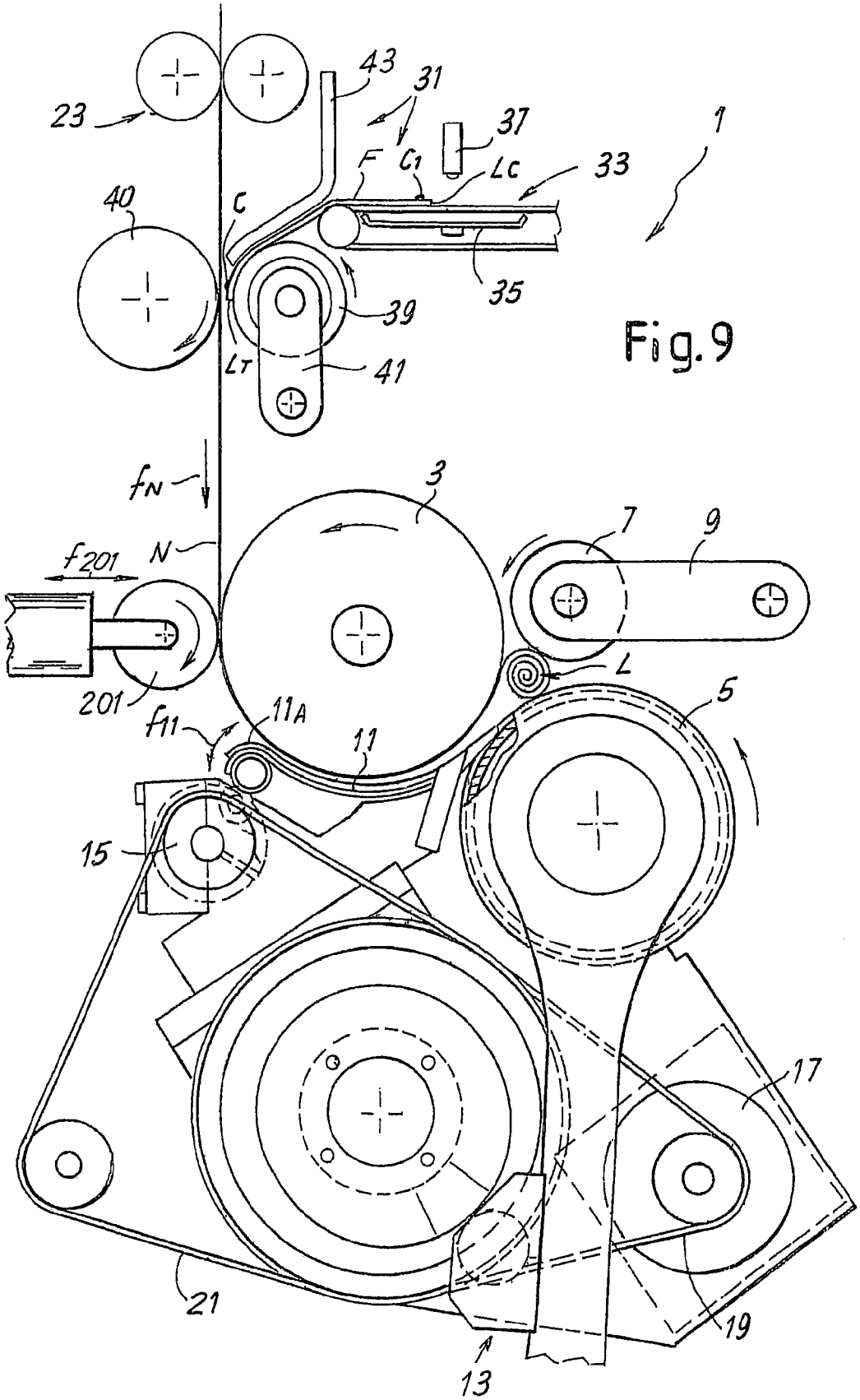
FIG. 9 is a schematic side view of a further embodiment of the invention.

FIG. 9 shows a further embodiment of the invention, similar to the embodiment of FIG. 1. The same numbers are used to indicate parts that are the same as, or equivalent to those of FIG. 1. Unlike the configuration of FIG. 1, in FIG. 9 there are means for the longitudinal severing of the web material N and of the sheet F wrapped around the wound material. In a possible embodiment, illustrated here, these severing means comprise disc-shaped blades 201 cooperating with the winder roller 3, which contains ring-shaped grooves for said purpose. The disc-shaped blades may be serrated or smooth. In a possible embodiment, these blades cooperate with respective edges of the ring-shaped grooves in the winder roller 3 to obtain a scissors-type severing action but, though currently preferred, this is not indispensable.

With a configuration of this kind, the web material is divided into single longitudinal strips, each of which gives rise to a roll of axial length corresponding to the length of the end product. Each roll is wrapped externally with a sheet F the same size as the roll. In this case, at each winding cycle instead of a log to cut into sections in a subsequent stage in the process, the result is a series of already cut rolls. This solution is particularly suitable in the case of manufacturing rolls for industrial or professional uses, that are normally larger in diameter than the rolls for domestic uses and would consequently be more difficult to cut if they were produced in a long log.

A similar longitudinal cutting system can also be easily achieved in the other embodiments illustrated.

The disc-shaped blades preferably perform the longitudinal cutting (i.e. in the direction in which the material advances) of the sheet material F too. However, it is equally possible for this sheet to be fed into the machine already divided into single portions of sheet substantially aligned with the disc-shaped blades 201.

It should be understood that the drawing only illustrates one example, given simply as a practical demonstration of the invention, which may vary in form and arrangement without departing from the concept of the invention.

The invention claimed is:

1. A peripheral rewinder machine for producing rolls of web material, comprising: a peripheral winder unit comprising a first winder roller and a second winder roller, which define a nip therebetween; a path for delivering web material to said peripheral winder unit, said path extending through said nip between said first winder roller and said second winder roller; a system for providing continuous feed of said web material into said peripheral winder unit, said web material being fed through said nip between said first winder roller and said second winder roller to form a roll in said peripheral winder unit; a distributor of a sheet material for wrapping rolls formed by said peripheral winder unit, said distributor being constructed and arranged to feed a length of said sheet material to said peripheral winder unit to wrap a roll with said sheet material on completion of winding of said roll in said peripheral winder unit without stopping delivery of the web material; and wherein said distributor is further constructed and arranged to apply said length of said sheet material to the web material upstream from said nip, the sheet material thus traveling through said nip along with the web material in said peripheral winder unit to wrap the roll.

2. The rewinder machine as claimed in claim 1, wherein said distributor is along said path for delivering said web material.

3. The rewinder machine as claimed in claim 1, wherein said winder unit further comprises a third winder roller with a mobile axis that, together with said first winder roller and said second winder roller, defines a winding cradle for formation of the rolls.

4. The rewinder machine as claimed in claim 3, wherein said distributor of said sheet material advances lengths of said sheet material towards one of said first winder roller, said second winder roller or said third winder roller, whereby said lengths of sheet material are transferred for wrapping around a respective one of said rolls formed.

5. The rewinder machine as claimed in claim 1, wherein said distributor of said sheet material feeds said sheet material into said winder unit around the completed roll.

6. The rewinder machine as claimed in claim 1, wherein said distributor comprises an applicator of adhesive constructed and arranged so as to apply an adhesive at least in a vicinity of one end of said length of the sheet material, on a surface of said sheet material which will be brought in contact with the web material.

7. The rewinder machine as claimed in claim 6, wherein said applicator of adhesive is constructed and arranged so as to apply an adhesive in a vicinity of two ends of said length of the sheet material, on the surface of said sheet material which will be brought in contact with the web material.

8. The rewinder machine as claimed in claim 1, comprising severing means for longitudinally severing the web material.

9. The rewinder machine as claimed in claim 8, wherein said severing means is constructed and arranged so as to cut both the web material and the sheet material.

10. A rewinder machine for producing rolls of web material, comprising: a winder unit comprising a first winder roller and a second winder roller, which define a nip therebetween; a path for delivering web material to said winder unit, said path extending through said nip between said first winder roller and said second winder roller; a system for providing continuous feed of said web material into said winder unit, said web material being fed through said nip between said first winder roller and said second winder roller; a distributor of a sheet material for wrapping rolls formed by said winder unit, said distributor being constructed and arranged to feed a length of said sheet material to said winder unit to wrap a roll with said sheet material on completion of winding of said roll without stopping delivery of the web material; and wherein said distributor is further constructed and arranged to apply said length of said sheet material to the web material upstream from said nip, the sheet material thus traveling through said nip along with the web material, wherein said winder unit further comprises a third winder roller with a mobile axis that, together with said first winder roller and said second winder roller, defines a winding cradle for formation of the rolls, wherein said distributor of said sheet material advances lengths of said sheet material towards one of said first winder roller, said second winder roller or said third winder roller, whereby said lengths of sheet material are transferred for wrapping around a respective one of said rolls formed, and wherein said third winder roller comprises a device for engaging the length of said sheet material to wrap the length of said sheet material around a wound roll.

11. A rewinder machine for producing rolls of web material, comprising: a winder unit; a path for delivering web material to said winder unit; a system for providing continuous feed of said web material into said winder unit; a distributor of a sheet material for wrapping rolls formed by said winder unit, said distributor being constructed and arranged to feed a length of said sheet material to said winder unit to wrap a roll with said sheet material on completion of winding of said roll without stopping delivery of the web material;

wherein said winder unit comprises a first winder roller and a second winder roller, which define a nip therebetween, through which said web material passes, and a third winder roller with a mobile axis that, together with said first winder roller and said second winder roller, defines a winding cradle for the formation of the rolls;

wherein said web material is fed through said nip;

wherein said distributor of said sheet material is arranged so as to advance lengths of said sheet material towards said rolls by said third winder roller; and wherein said third winder roller has at least one suction portion for engaging said length of the sheet material.

12. A peripheral rewinder machine for producing rolls of web material, comprising: a peripheral winder unit comprising a first winder roller and a second winder roller, which define a nip therebetween; a path for delivering web material to said peripheral winder unit, said path extending through said nip between said first winder roller and said second winder roller to form a roll in said peripheral winder unit; a system for providing continuous feed of said web material into said peripheral winder unit, said web material being fed through said nip between said first winder roller and said second winder roller; a distributor of a sheet material for wrapping rolls formed by said winder unit, said distributor being constructed and arranged to feed a length of said sheet material to said peripheral winder unit to wrap a roll with said sheet material on completion of winding of said roll in said peripheral winder unit without stopping delivery of the web material; and wherein said distributor is further constructed and arranged to cause adhesion of said length of said sheet material to the web material upstream from said nip, the sheet material thus being moved through said nip by the web material.

13. A rewinder machine for producing rolls of web material, comprising: a winder unit; a path for delivering web material to said winder unit; a system for providing continuous feed of said web material into said winder unit; a distributor of a sheet material for wrapping rolls formed by said winder unit, said distributor being constructed and arranged to feed a length of said sheet material to said winder unit to wrap a roll with said sheet material on completion of winding of said roll without stopping delivery of the web material;

wherein said winder unit comprises a first winder roller and a second winder roller, which define a nip therebetween, through which said web material passes, and a third winder roller with a mobile axis that, together with said first winder roller and said second winder roller, defines a winding cradle for formation of the rolls;

wherein said web material is fed through said nip;

wherein said distributor of said sheet material is arranged so as to advance a length of said sheet material towards said rolls by said third winder roller; and wherein said third winder roller comprises a device for engaging the length of said sheet material to wrap the length of said sheet material around a wound roll.

* * * * *